US006797136B2

(12) United States Patent
Shimamune

(10) Patent No.: US 6,797,136 B2
(45) Date of Patent: Sep. 28, 2004

(54) ELECTROLYTIC CELL

(75) Inventor: Takayuki Shimamune, Tokyo (JP)

(73) Assignee: Akzo Nobel N.V., Arnhem (NL)

( * ) Notice: Subject to any disclaimer, the term of this patent is extended or adjusted under 35 U.S.C. 154(b) by 213 days.

(21) Appl. No.: 10/233,621

(22) Filed: Sep. 4, 2002

(65) Prior Publication Data

US 2003/0047447 A1 Mar. 13, 2003

Related U.S. Application Data

(60) Provisional application No. 60/317,438, filed on Sep. 7, 2001.

(51) Int. Cl.[7] ..... C25B 11/03
(52) U.S. Cl. ..... 204/252; 204/280; 204/284
(58) Field of Search ..... 204/242, 252, 204/280, 284

(56) References Cited

U.S. PATENT DOCUMENTS 4,502,935 A 3/1985 Lohrberg ..... 204/253
4,556,470 A 12/1985 Samejima ..... 204/266
5,693,213 A 12/1997 Shimamune ..... 205/510
5,766,429 A 6/1998 Shimamune ..... 204/257
5,938,901 A 8/1999 Shimamune ..... 204/283
6,117,286 A * 9/2000 Shimamune et al. ..... 204/252
2002/0189936 A1 * 12/2002 Shimamune ..... 204/242

FOREIGN PATENT DOCUMENTS

EP 1076115 1/2001

* cited by examiner

*Primary Examiner*—Roy King
*Assistant Examiner*—Harry D. Wilkins, III
(74) *Attorney, Agent, or Firm*—David J Serbin

(57) ABSTRACT

The present invention relates to a retrofitted electrolytic cell and a method for retrofitting an electrolytic cell comprising an anode and a cathode compartment, a separator partitioning the compartments, said cathode compartment comprising a hydrogen evolving cathode. The method comprises making at least one substantially horizontal slit in the hydrogen evolving cathode resulting in plural cathode members, bending the edge of at least one cathode member at the slit away from the separator, arranging a gas diffusion electrode to the cathode members on the side facing the separator, and arranging an electrolyte layer to the gas diffusion electrode. The invention also relates to the use of a retrofitted electrolytic cell.

15 Claims, 3 Drawing Sheets

ELECTROLYTIC CELL

This application claims benefit of Provisional U.S. Application 60/317,438 filed on Sep. 7, 2001.

The present invention relates to a method for retrofitting a conventional hydrogen evolving cathode cell to a gas diffusion electrode cell. The invention also relates to the retrofitted electrolytic cell and the use thereof.

BACKGROUND OF THE INVENTION

The electrolytic production of alkali metal hydroxides is today of considerable importance, although a large amount of energy is consumed in the electrolysis processes. Many attempts have been made to lower the energy consumption, e.g. by using a gas diffusion cathode in the electrolytic cell which today is believed to have the highest capability of saving electric energy and lower the production costs.

If the production of sodium hydroxide from brine in a conventional hydrogen evolving cathode cell in which the electrolytic reaction (1) occurs instead is performed in a gas diffusion cathode cell, the reaction (1) is replaced by reaction (2).

$$2NaCl+2H_2O \rightarrow Cl_2+2NaOH+H_2,\ E_0=2.21\ V \quad (1)$$

$$2NaCl+\tfrac{1}{2}O_2+H_2O \rightarrow Cl_2+2NaOH,\ E_0=0.96\ V \quad (2)$$

Thus, by converting a hydrogen evolving cathode cell to a gas diffusion electrode cell, the cell voltage is reduced from 2.21 V to 0.96 V, thus an energy saving of about 60% becomes possible. Accordingly, various investigations have been conducted for converting conventional cells for production of e.g. chloralkali electrolysis to gas diffusion electrode cells.

U.S. Pat. No. 5,693,213 describes briefly a method for converting a conventional salt water electrolytic cell provided with a conventional hydrogen evolving cathode to a gas diffusion cathode cell in which the cathode chamber is partitioned into a solution chamber and a gas chamber by providing a gas diffusion cathode to the original cell. However, this conversion requires a large reconstruction cost due to the complicated cathode chamber structure needed for controlling the pressure arisen between the gas diffusion electrode and the ion exchange membrane.

The present invention intends to solve the above-mentioned problems.

THE INVENTION

The present invention relates to a method for retrofitting an electrolytic cell comprising an anode and a cathode compartment, a separator partitioning the compartments, said cathode compartment comprising a hydrogen evolving cathode, wherein the method comprises making at least one substantially horizontal slit in the hydrogen evolving cathode resulting in plural cathode members, bending the edge of the cathode member at the slit away from the separator, arranging a gas diffusion electrode to at least one of the cathode members on the side facing the separator, and arranging an electrolyte layer to the gas diffusion electrode.

It has been surprisingly found that the present invention can provide advantageous operation to a retrofitted gas diffusion electrode cell. The invention enables a simple retrofitted gas diffusion electrode cell by converting a conventional hydrogen evolving cathode cell at a low cost. The invention further ascertains low cell voltage and stable operation. It can thus enable homogeneous connection between the separator and the gas diffusion electrode. The relatively short distance between the separator and the gas diffusion electrode minimises the cell voltage and makes the cell operation almost as energy-saving as a zero gap cell. The invention also ascertains a safe operation minimising flooding of electrolyte in the cathode compartment.

By "retrofitting an electrolytic cell" is generally meant equipping or converting an already existing electrolytic cell with new parts.

By the term "separator" is meant any separating mean, such as an ion exchange membrane, a diaphragm or other suitable means. Suitable membranes may be made of perfluorinated, sulphonated or teflon-based polymers, or ceramics. Also polystyrene-based membranes or diaphragm of polymers or ceramics may be used. There are several commercially available membranes suitable for use such as Nafion™ 324, Nafion™ 550 and Nafion™ 961 available from Du Pont, and Flemion™ available from Asahi Glass.

By the term "slit" is meant a long straight incision or opening, suitably a through-line, in the hydrogen evolving cathode.

According to one embodiment, the distance between the slits is from about 100 to about 600 mm, preferably from about 200 to about 400 mm. The slits suitably are from about 2 to 10 mm, preferably from about 3 to about 5 mm wide. The edge of the cathode member can be bent in any direction as long as it allows the electrolyte layer to pass through the slit, but preferably, the edge is bent downwards away from the separator.

By the terms "existing cathode" and "cathode members" is meant any originally existing hydrogen evolving cathode or members of an existing hydrogen evolving cathode used in a conventional electrolytic cell.

By the term "electrolyte layer" is meant a hydrophilic layer capable of retaining electrolyte substantially deriving from the anode compartment, e.g. in the production of sodium hydroxide in which process sodium ions carrying water molecules are transported over the separator. The electrolyte layer is arranged between the separator and the gas diffusion electrode and suitably comprises a carbon cloth, e.g. a graphite cloth, nonwoven cloth filter of fluorinated resins, ceramic fiber cloth, ceramic fluor resin cloth, or a ceramic coated carbon cloth retaining the electrolyte between the gas diffusion electrode and the separator. The carbon cloth suitably extends through the slits made in the cathode members as further described herein. The electrolyte can in this way be drained from the electrolyte layer avoiding flooding of the gas diffusion electrode. The electrolyte can thus leave the cathode compartment in a controlled way at the oxygen-containing gas-supplied side of the cathode compartment.

According to one embodiment, the electrolyte layer is from about 0.1 to about 2 mm thick, preferably from about 0.2 to about 1 mm.

According to one embodiment, the gas diffusion electrode comprises several electrode members. The electrode members are suitably shaped as belts or in patchwork configuration, preferably in patchwork configuration, suitably in which configuration the gas diffusion electrode members are substantially square-shaped. Suitably, the electrode members have a length of from about 2 to about 40 cm, preferably from about 10 to about 30 cm in the vertical direction. If the vertical length is less than about 2 cm, the manufacturing of the electrode members can be complicated. If the vertical length is longer than about 40 cm, the lower portion of the electrode member may be exposed to higher electrolyte pressure than the upper portion, which can reduce the rate of the electrolytic reaction taking place at the gas diffusion electrode member due to difficulties in supplying oxygen-containing gas. The size of the gas diffusion electrode is suitably dimensioned relative to the pressure difference of the electrolyte in the vertical direction. In this way, an optimised homogeneous gas supply can be provided. According to one embodiment, the gas diffusion electrode can pass through the formed slits together with the electrolyte layer. However, even though this embodiment results in extra electrode reaction area, it is preferred that the gas diffusion does not pass through the slits because the extra electrode reaction area will be further away from the separator than the rest of the electrode area which will increase the ohmic loss at said extra electrode reaction area.

Suitably, the gas diffusion electrode members have a length of from about 2 to about 40 cm, preferably from about 10 to about 30 cm in the horizontal direction. The space between adjacent electrode members in the vertical direction may be from about 1 to about 5 mm, preferably from about 2 to about 3 mm.

Preferably, a space is provided between adjacent gas diffusion electrode members in the horizontal direction. Thereby, the gas diffusion electrode members do not necessarily continue over the whole horizontal direction in the cell, but may be divided into plural parts in the horizontal direction. In an embodiment where the electrode members are divided in the horizontal direction, electrolyte can flow down from each space formed by the horizontal division. Thus, electrolyte can easily be released from the electrode members. Preferably, the space between adjacent electrode members in the horizontal direction is from about 1 to about 5 mm, preferably from about 2 to about 3 mm. The structure of plural electrode members arranged both in the horizontal direction and the vertical direction adjacent to each other with a space in between can be described as a patchwork configuration.

The gas diffusion electrode may be a weeping gas diffusion electrode, a semihydrophobic gas diffusion electrode or according to any of the embodiments of gas diffusion electrodes as described in European patent applications No. 01850109.8, No.00850191.8, No.00850219.7 or and U.S. Pat. No. 5,938,901 and U.S. Pat. No. 5,766,429.

According to one embodiment, the method involves arranging resilient means between the existing hydrogen evolving cathode and the gas diffusion electrode. It has been found that resilient means contribute to a more homogeneous contact between the gas diffusion electrode and the electrolyte layer. Furthermore, it has been found that the resilient means can secure safe retention of electrolyte between the separator and the gas diffusion electrode. The resilient means can also play the role of current distributor. Such resilient means may be selected from expanded mesh, wire net, springs, ribs, elastic louvers, perforated plates, metal foams or mixtures thereof, suitably comprising plural members made of a porous metal arranged so that gas and electrolytes thereby easily can be supplied and removed from the gas diffusion electrode. Preferably, the resilient means have substantially the same dimensions as the gas diffusion electrode or plural members thereof so that the resilient means can be individually fitted thereto. The dimensions of the resilient means connected to the gas diffusion electrode are suitably not larger than 40 cm, because the distance to the separator can in those cases be inhomogeneous, which can lead to inhomogeneous current distribution. In case the dimensions are shorter than 10 cm, the manufacturing of the resilient means may be very complicated. The dimensions of the resilient means are suitably from about 10 to about 40 cm, preferably from about 10 to about 30 cm, and most preferably from about 20 to about 25 cm.

The space between the resilient means suitably is from about 1 to about 5 mm, preferably from about 2 to about 3 mm. In case the space is too big, the cell voltage may be too high due to inhomogeneous current distribution in the cell. If the space is too small, the independent adjustments of the electrode members to the resilient means.

The existing cathode being the original hydrogen evolving cathode used in the conventional cell can work as a current distributor in the retrofitted cell.

The invention also relates to a retrofitted electrolytic cell comprising an anode and a cathode compartment, a separator partitioning said compartments, said cathode compartment comprising cathode members having at least one substantially horizontal slit between adjacently vertically arranged cathode members of which at least one is bent away from the separator at the slit, a gas diffusion electrode arranged to at least one of the cathode members on the side facing the separator, and an electrolyte layer arranged to the gas diffusion electrode.

According to one embodiment, the retrofitted electrolytic cell comprises resilient means arranged between the cathode members and the gas diffusion electrode, suitably selected from expanded mesh, wire net, springs, ribs, elastic louvers, metal foams or mixtures thereof.

Suitably, the gas diffusion electrode comprises several electrode members as further described above, suitably arranged in patchwork configuration or belt structure, preferably in patchwork configuration, suitably with square-shaped gas diffusion electrode members.

The electrolyte layer suitably is from about 0.1 to about 2 mm, preferably from about 0.2 to about 1 mm thick.

According to one embodiment, the distance between the slits is from about 100 to about 600 mm, preferably from about 200 to about 400 mm.

Further embodiments and specifications of the retrofitted gas diffusion electrode cell are described in the detailed method for retrofitting the cell.

The invention further relates to the use of the retrofitted electrolytic cell described herein for production of e.g. hydrogen peroxide, alkali metal hydroxide such as KOH and/or NaOH, but may also be used for production of e.g. $Na_2SO_4$, HCl, preferably alkali metal hydroxide.

DETAILED DESCRIPTION OF THE DRAWINGS

Figure 1:
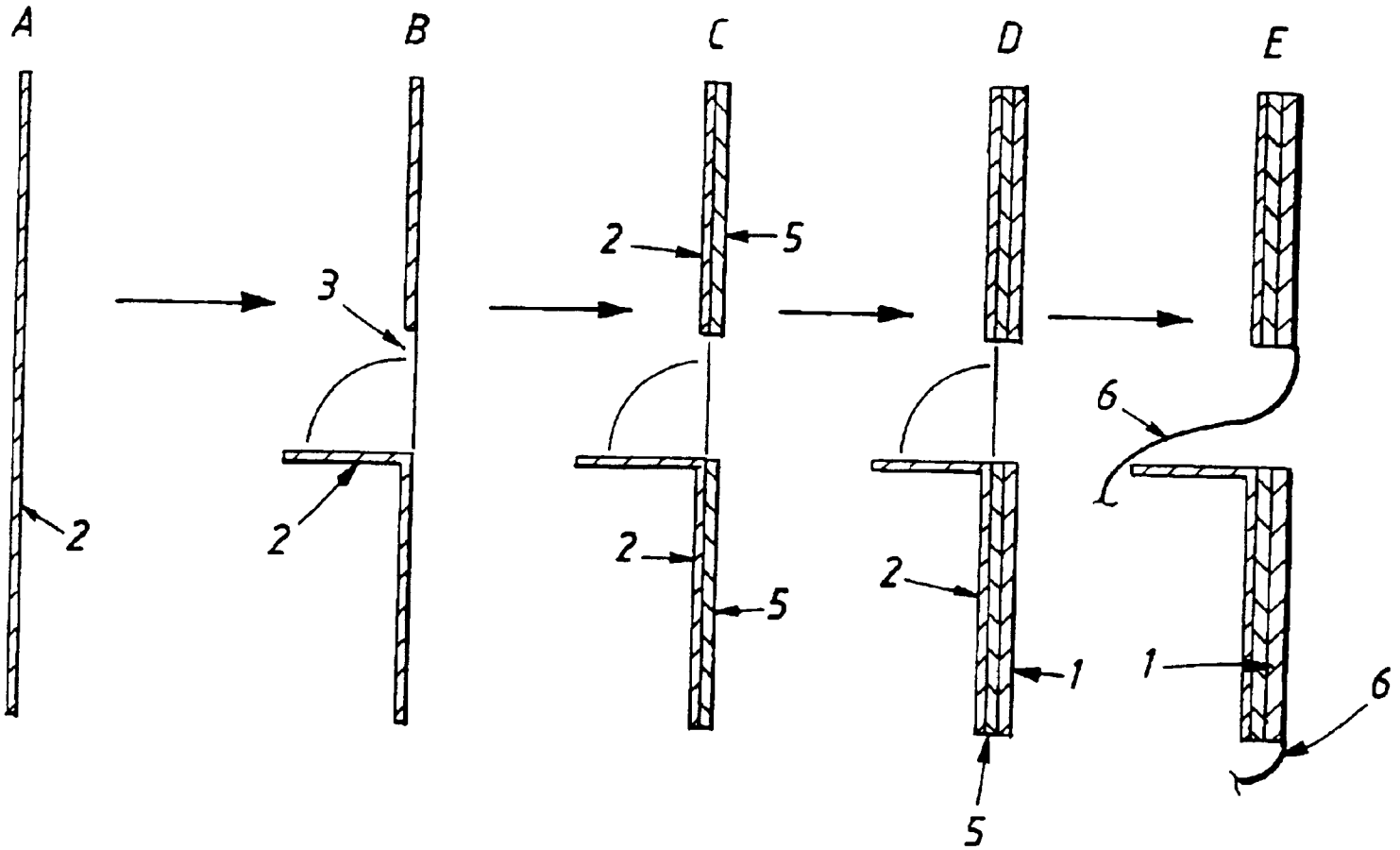
FIG. 1 shows in cross-section a step by step scheme for the manufacture of a retrofitted gas diffusion cathode cell.

FIG. 1 shows a side view of a step by step scheme for the manufacture of a retrofitted gas diffusion electrode cell. From step A, starting with a conventional cell comprising a hydrogen evolving cathode 2, openings or slits 3 are provided as shown in step B. One side of the existing cathode 2 is provided with resilient means 5 as shown in step C. To these resilient means 5, gas diffusion cathode members 1 are provided as shown in step D. On the gas diffusion cathode members 1, an electrolyte layer 6 passing through the slit 3 is provided as shown in step E.

Figure 2:
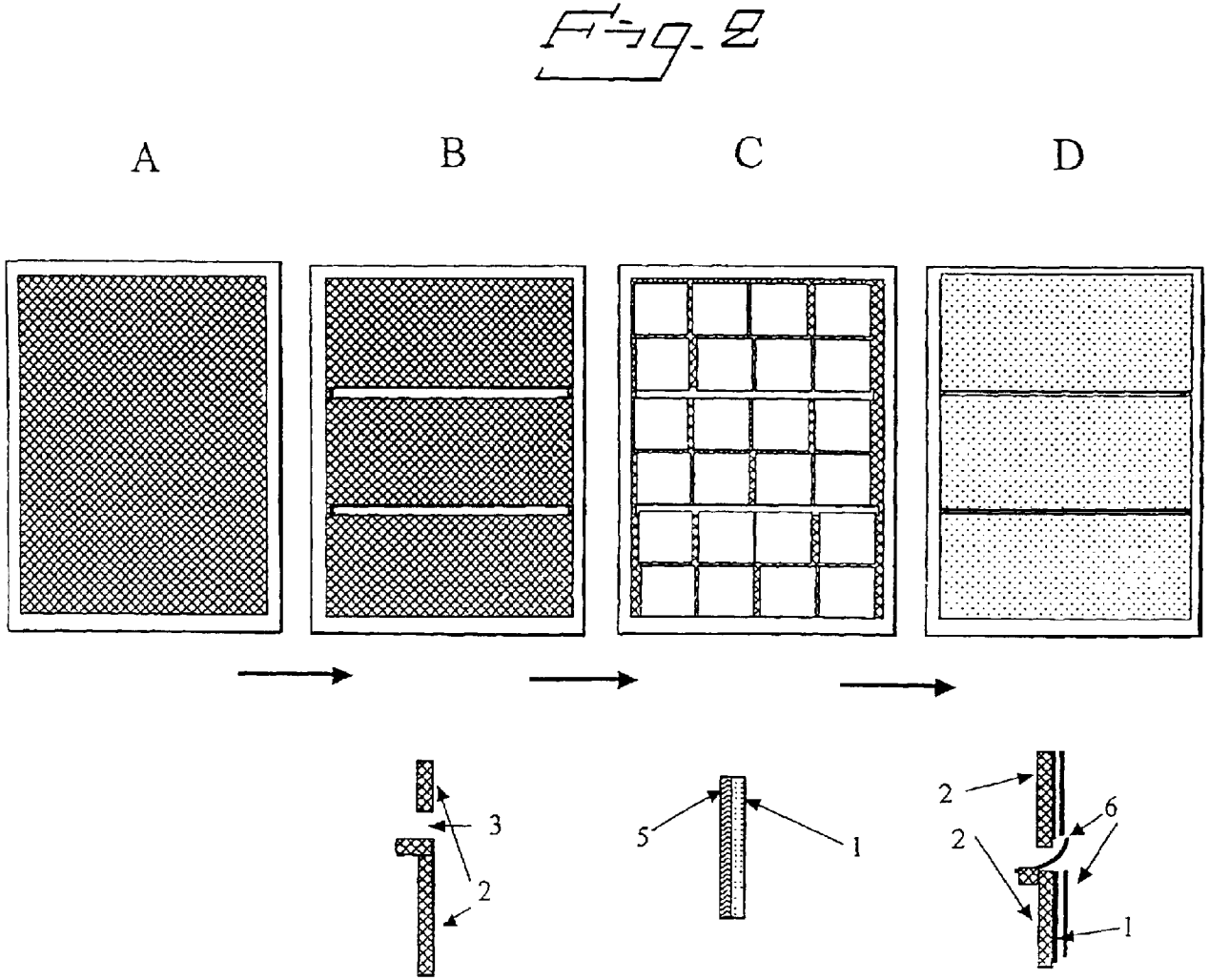
FIG. 2 also shows the manufacture of a retrofitted gas diffusion cathode cell.

FIG. 2 shows a similar scheme viewed from the side facing the separator and from the side of the cell. Slits 3 are made in the existing cathode 2 as shown in step B. Gas diffusion cathode members 1 provided with resilient means 5 facing the existing cathode 2 are provided on the cathode members 2 as shown in step C. The gas diffusion cathode members 1 are subsequently provided with an electrolyte layer 6 (partitioned in three pieces) as shown in step D.

Figure 3:
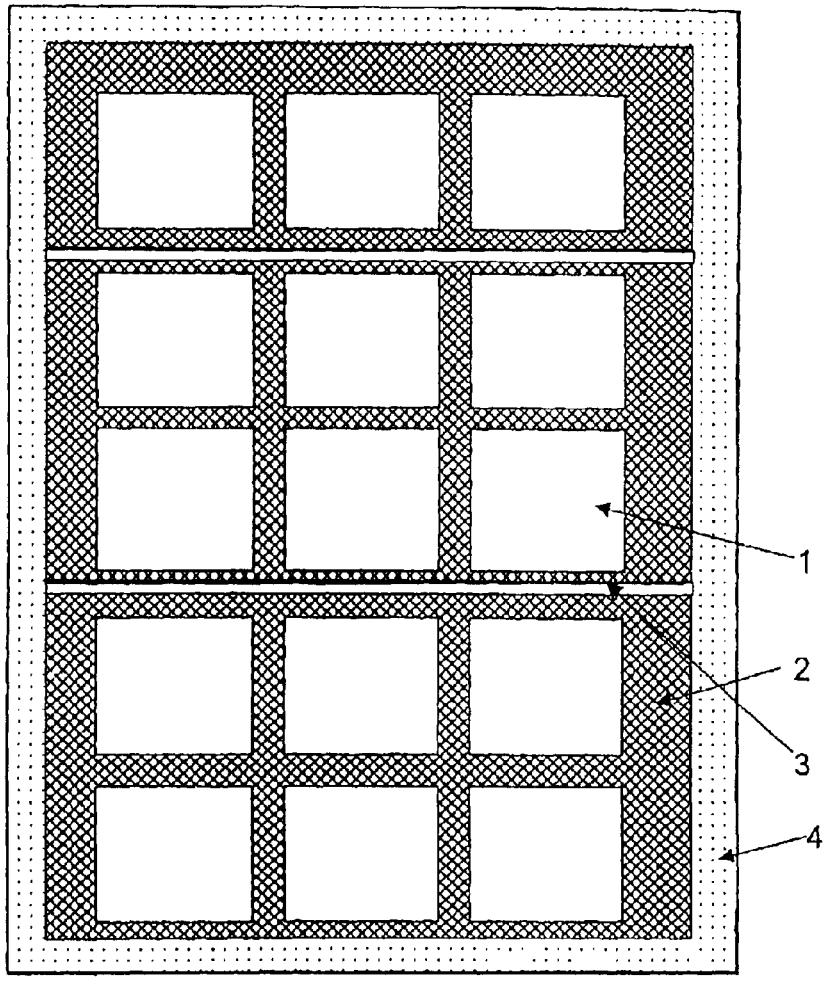
FIG. 3 shows the electrode structure of a manufactured retrofitted gas diffusion cathode cell (the electrolyte layer 4 not shown above the gas diffusion cathode members 1).

FIG. 3 shows a part of a manufactured retrofitted gas diffusion cathode cell viewed from the side facing the separator (not shown). The gas diffusion cathode members 1 are provided on resilient members (not shown) which in turn are attached to the existing cathode 2. The slits 3 are provided between the cathode members 2.

Figure 4:
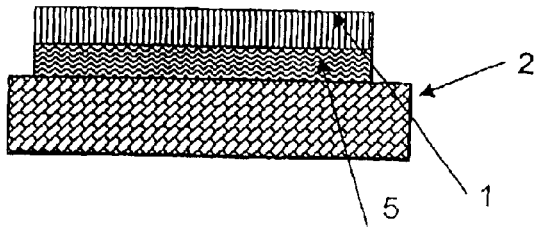
FIG. 4 shows a cross-section of a retrofitted gas diffusion cathode.

FIG. 4 shows a cross-section of a retrofitted gas diffusion cathode cell viewed from above, wherein the gas diffusion cathode 1 is attached to resilient means 5, which in turn is attached to the existing cathode 2.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. The following examples will further illustrate how the described invention may be performed without limiting the scope of it.

EXAMPLE 1

A conventional pilot electrolytic membrane cell comprising an existing hydrogen evolving cathode (a nickel expanded mesh) for production of alkali metal hydroxide having a height of 1.2 m and a width of 0.9 m was retrofitted to a gas diffusion electrode cell. The nickel expanded mesh was cut along a horizontal line at the height of 40 cm and 80 cm from the bottom of the cell. The mesh was bent at the cut portions to make 5 mm wide openings, in which 5 mm of the lower portion of the cutting line was bent towards the opposite side of the membrane. A drain tube was welded at the centre of the bottom of the cathode compartment for draining produced electrolyte. Gas inlet and outlet tubes from the conventional cell were arranged. A PTFE (polytetrafluoroethylene) gas distributor, provided with pores, was attached to the cathode compartment. 200 mm×200 mm dimensioned members of a gas diffusion electrode were attached to a resilient silver plated nickel expanded mesh working as a current distributor. The gas diffusion electrode members and the current distributors attached thereto were spot-welded to the existing cathode with 2–3 mm gaps in between and 5 mm slits or openings were also made in the gas diffusion electrode members and the current distributor at the same place as the existing cathode so as to provide a slit through the whole assembly. The gas diffusion electrode was made of silver plated nickel screen and a microporous fluorocarbon backing. A carbon cloth, used as electrolyte layer for retaining the catholyte produced during the electrolysis, comprising a semi-hydrophobic property made of PAN (polyacrylonytrile) carbon fibre available from Toho Rayon, was arranged between the membrane and the gas diffusion electrode thereby covering the surface of the gas diffusion electrode facing the membrane. Three pieces of carbon cloth were used to cover the gas diffusion electrode surface. The lower portion of the carbon cloth was bent away from the membrane through the openings of the existing cathode. The electrolytic cell was then assembled for trials.

170 g/dm$^3$ of brine was circulated in the anode compartment and steam saturated oxygen at 80° C. was supplied to the cathode compartment. The electrolysis was started at a current density of 5 A/dm$^2$. After 1 hour of operation, the current density was increased gradually to 30 A/dm$^2$. The cell voltage was 1.95 V after 3 hours of operation at 80° C. and with an oxygen supply two times higher than the theoretical amount. The obtained 35 wt % NaOH was drained from the cathode compartment. The current efficiency was 95%. The cell voltage was stabilised at 2 V after more than 1000 hours.

EXAMPLE 1.1

The same retrofitting as in example 1 was performed but with one piece of carbon cloth instead of three pieces. Electrolysis was performed under the same conditions as in example 1, which resulted in an increase in cell voltage from the initial value of 2 V to 2.4 V after 100 hours. The cell was opened after 150 hours of electrolysis. Flooding of the lower portion of the cell was observed.

EXAMPLE 1.2

Similar retrofitting as in example 1 was performed but without a current distributor between the existing cathode and the gas diffusion electrode members. Electrolysis was performed under the same conditions as in example 1. The cell voltage was 2.2 V at a current density 30 A/dm$^2$. Even though the current density was lowered to 5 A/dm$^2$, the cell voltage was maintained at 2.2 V. No reduction of the cell voltage was observed after 1000 hours of operation. The cell was opened after 1000 hours of operation and partially dry portions on the surface of the gas diffusion electrode were found. This resulted from inhomogeneous contact between the gas diffusion electrode and the electrolyte layer.

EXAMPLE 2

A gas diffusion electrode was prepared by coating silver paste on a silver expanded mesh. PTFE was used as binder. Sintering was performed first at 150° C. for 20 minutes and then at 250° C. for 30 minutes. Silver powder having a particle size of 10 to 100 nm was mixed with 20 wt % of a Nafion™ solution and subsequently applied on the silver paste followed by further sintering at 140° C. The obtained gas diffusion electrode members were attached as in example 1. The whole cell assembly used was the same as of example 1 except the gas diffusion electrode. Electrolysis was performed under the same conditions as of example 1 and a cell voltage around 2 V at a current density of 30 A/dm$^2$ was obtained. The cell voltage was kept at around 2 V even after 2000 hours of operation.

EXAMPLE 2.1

The gas diffusion electrode as of example 2 was prepared but with the dimensions 40×40 cm. The cell was assembled in the same way and operation thereof was performed under the same conditions. The cell voltage was 2.3 V at 30 A/dm$^2$ thus 0.3 V higher than example 2. Inhomogeneous connection between the gas diffusion electrode and the ion exchange membrane was observed due to the big-sized gas diffusion electrode. Partial dry portions could be observed after opening of the cell after 1500 hours of operation.

What is claimed is:

1. Method for retrofitting an electrolytic cell comprising an anode and a cathode compartment, a separator partitioning said compartments, said cathode compartment comprising a hydrogen evolving cathode, wherein the method comprises making at least one substantially horizontal slit in the hydrogen evolving cathode resulting in plural cathode members, bending said at least one substantially horizontal slit away from the separator at the edge of at least one of said plural cathode members, arranging a gas diffusion electrode to at least one of said plural cathode members on the side facing the separator, and arranging an electrolyte layer to said gas diffusion electrode.

2. Method according to claim 1 further comprising arranging resilient means between the cathode members and the gas diffusion electrode.

3. Method according to claim 1 further comprising arranging resilient means selected from the group consisting of expanded mesh, wire nets, springs, ribs, elastic louvers, metal foams or mixtures thereof between the cathode members and the gas diffusion electrode.

4. Method according to any of claims 1, wherein the gas diffusion electrode comprises plural gas diffusion electrode members.

5. Method according to claim 1, wherein the gas diffusion electrode comprises plural gas diffusion electrode members having a patchwork configuration.

6. Method according to claim 1, wherein the electrolyte layer comprises a graphite cloth.

7. Method according to claim 1, wherein the electrolyte layer is from about 0.1 to about 2 mm thick.

8. Method according to claim 1, wherein the distance between adjacent slits is from about 100 to about 600 mm.

9. Retrofitted electrolytic cell comprising an anode and a cathode compartment, a separator partitioning said compartments, said cathode compartment comprising cathode members having at least one substantially horizontal slit in between adjacently vertically arranged cathode members of which at least one is bent away from said separator at the slit, a gas diffusion electrode arranged to at least one of said cathode members on the side facing the separator, and an electrolyte layer arranged to the gas diffusion electrode.

10. Retrofitted electrolytic cell according to claim 9, wherein resilient means are arranged between the cathode members and the gas diffusion electrode.

11. Retrofitted electrolytic cell according to claim 9, wherein the resilient means selected from the group consisting of expanded mesh, wire nets, springs, ribs, elastic louvers, metal foams or mixtures thereof are arranged between the cathode members and the gas diffusion electrode.

12. Retrofitted electrolytic cell according to claim 9, wherein the gas diffusion electrode comprises plural gas diffusion electrode members.

13. Retrofitted electrolytic cell according to claim 9, wherein the gas diffusion electrode comprises plural gas diffusion electrode members having a patchwork configuration.

14. Retrofitted electrolytic cell according to claim 9, wherein the electrolyte layer is from about 0.1 to about 2 mm thick.

15. Retrofitted electrolytic cell according to claim 9, wherein the distance between adjacent slits is from about 100 to about 600 mm.

* * * * *